US009862396B2

(12) United States Patent
Nandedkar et al.

(10) Patent No.: US 9,862,396 B2
(45) **Date of Patent: *Jan. 9, 2018**

(54) SYSTEM AND METHOD FOR DETERMINING A QUALITY VALUE OF A LOCATION ESTIMATION OF EQUIPMENT

(71) Applicant: General Electric Company, Schenectady, NY (US)

(72) Inventors: Vishram Vinayak Nandedkar, Bangalore (IN); Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 382 days.

This patent is subject to a terminal disclaimer.

(21) Appl. No.: 14/559,081

(22) Filed: Dec. 3, 2014

(65) Prior Publication Data

US 2015/0088345 A1 Mar. 26, 2015

Related U.S. Application Data

(63) Continuation-in-part of application No. 13/480,814, filed on May 25, 2012, now Pat. No. 8,965,604, which is a continuation-in-part of application No. 12/047,496, filed on Mar. 13, 2008, now Pat. No. 8,190,312.

(51) Int. Cl.
*B61L 25/02* (2006.01)

(52) U.S. Cl.
CPC ..... *B61L 25/021* (2013.01); *B61L 25/025* (2013.01); *B61L 25/026* (2013.01); *B61L 2205/04* (2013.01)

(58) Field of Classification Search
CPC .... B61L 25/025; B61L 25/021; B61L 25/026; B61L 2205/04
USPC ... 701/19, 20, 200, 207, 213, 214, 216, 217, 701/220; 342/357.3, 357.32
See application file for complete search history.

(56) References Cited

U.S. PATENT DOCUMENTS

| | | | |
|---|---|---|---|
| 5,129,605 | A | 7/1992 | Burns et al. |
| 6,597,987 | B1 | 7/2003 | Barton |
| 6,631,322 | B1 | 10/2003 | Arthur et al. |

(Continued)

OTHER PUBLICATIONS

Kazakhstan Notice of Allowance issued in connection with corresponding KZ Application No. 2009/1529.1 dated Jun. 15, 2011.

*Primary Examiner* — Zachary L Kuhfuss
(74) *Attorney, Agent, or Firm* — Global Patent Operations; John A. Kramer

(57) ABSTRACT

A system is provided for determining a quality of a location estimation of a powered system at a location. The system includes a first sensor configured to measure a first parameter of the powered system at the location. The system further includes a second sensor configured to measure a second parameter of the powered system at the location. The system further includes a second controller configured to determine the location estimation of the powered system and the quality of the location estimation, based upon a first location of the powered system based on the first parameter, and a second location of the powered system based on the second parameter of the powered system. A method is also provided for determining a quality of a location estimation of a powered system at a location.

20 Claims, 6 Drawing Sheets

(56) References Cited

U.S. PATENT DOCUMENTS

| | | | | |
|---|---|---|---|---|
| 8,190,312 | B2 * | 5/2012 | Nandedkar | B61L 25/021 701/19 |
| 8,965,604 | B2 * | 2/2015 | Nandedkar | B61L 25/021 701/19 |
| 2004/0140405 | A1 | 7/2004 | Meyer | |
| 2005/0065726 | A1 * | 3/2005 | Meyer | B61L 25/021 701/470 |
| 2006/0200437 | A1 | 9/2006 | Howlett et al. | |
| 2007/0219680 | A1 * | 9/2007 | Kumar | B61L 3/006 701/19 |

* cited by examiner

SYSTEM AND METHOD FOR DETERMINING A QUALITY VALUE OF A LOCATION ESTIMATION OF EQUIPMENT

CROSS-REFERENCE TO RELATED APPLICATIONS

This application is a continuation-in-part of U.S. patent application Ser. No. 13/480,814, which was filed on 25 May 2012 (the "'814 Application"). The '814 Application is a continuation-in-part of U.S. patent application Ser. No. 12/047,496 (now U.S. Pat. No. 8,190,312), which was filed on 13 Mar. 2008 (the "'496 Application"). The entire subject matter of the '814 Application and the '496 Application are incorporated herein by reference.

BACKGROUND

Vehicles travel along a route from one location to another. Some vehicles travel along the route in an automatic mode in which, prior to traveling along the route, a controller predetermines one or more vehicle parameters, such as speed and throttle, pedal, or notch setting, for example, at each location along the route. In order to predetermine the vehicle parameter(s) at each location along the route, the controller may use a memory which prestores a characteristic of the route at each location, such as the grade, for example. While traveling along the route, the controller may need to be aware of the vehicle location to ensure that actual vehicle parameter(s) track or match the predetermined vehicle parameter(s) at each vehicle location. Additionally, since the route may include various vehicle parameter restrictions at various locations, such as a speed restriction, for example, the controller may need to be aware when the vehicle location is approaching a location of a restriction in order to adjust the vehicle parameter(s), if needed, to comply with the vehicle parameter restriction.

Alternatively, the vehicle may travel along the route in a manual mode, in which the vehicle operator is responsible for manually adjusting the vehicle parameters. As with the automatic mode, while traveling along the route, the vehicle operator may need to be aware of the vehicle location, such as when the vehicle location approaches a restriction location, for example. The vehicle operator can then manually adjust the vehicle parameter(s) to comply with a vehicle parameter restriction.

Some known systems have been designed to assist the controllers in the automatic mode and the vehicle operators in the manual mode by providing locations of the vehicle as the vehicle travels along the route. These systems, however, may rely solely on a global positioning satellite (GPS) system, which provide one measurement of the vehicle location based on satellite positioning, or other positioning systems using wireless network or wayside equipment, to provide raw position measurements of the vehicle. Upon receiving the positioning system measurement, the controller uses an internal memory to convert this raw position measurement to a distance measurement of the vehicle along the route.

As with any measurement system, such position measurement systems are capable of error, such as if a GPS receiver of the vehicle fails to communicate with a sufficient number of satellites in the GPS system or an error in the memory of the controller which may convert an accurate raw position measurement to an inaccurate distance measurement along the route, for example. Accordingly, it would be advantageous to provide plural independent distance measurements, such as an independent distance or position measurement in addition to a GPS measurement of the distance of the vehicle along the route, so to ensure that the distance estimation provided to the controller or vehicle operator is reliable. Additionally, it would be advantageous to assign a quality value to the distance estimation provided to the controller or vehicle operator.

BRIEF DESCRIPTION

In one embodiment, a method (e.g., for determining a location metric value of a distance estimation of equipment) includes determining a location of equipment based on plural determined positions of the equipment. The determined positions include a position-based location that is based on location data output by a position determination device and a speed-based position based on speed data output by a speed sensor.

In another embodiment, a system (e.g., a control system) includes at least one controller configured to determine a location of equipment based on plural determined positions of the equipment. The determined positions can include a position-based location that is based on location data and a speed-based position based on speed data. The at least one controller can include a single controller that performs the operations described herein, or multiple controllers that each perform the operations, and/or multiple controllers that each perform different operations and/or different parts of the operations.

BRIEF DESCRIPTION OF THE DRAWINGS

A more particular description of the embodiments of the inventive subject matter described herein will be rendered by reference to specific embodiments thereof that are illustrated in the appended drawings. Understanding that these drawings depict only some embodiments of the inventive subject matter and are not therefore to be considered to be limiting of the entire scope of the inventive subject matter, the embodiments of the inventive subject matter will be described and explained with additional specificity and detail through the use of the accompanying drawings in which.

DETAILED DESCRIPTION

Figure 1:
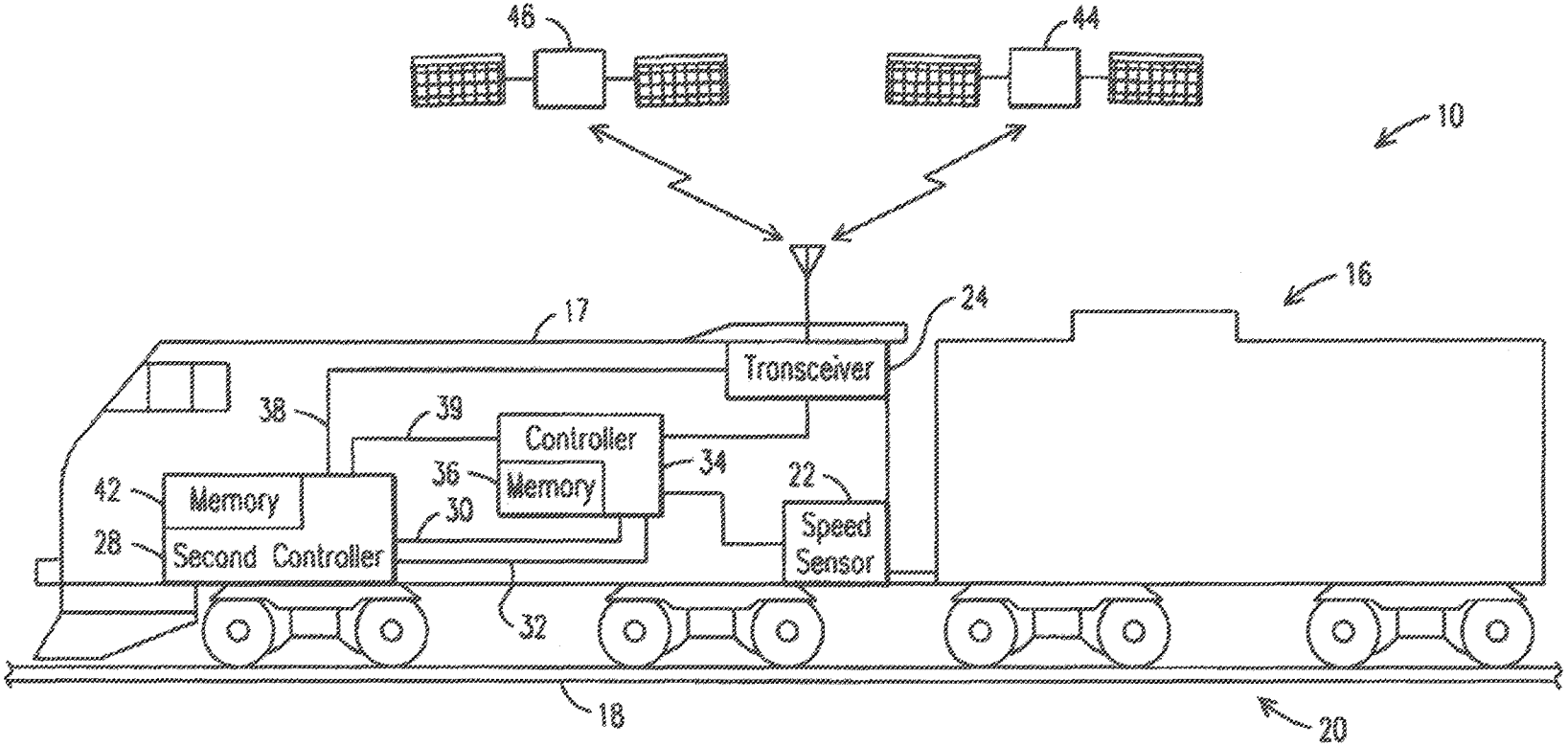
FIG. 1 is a side plan view of one example embodiment of a system for determining a location metric value of a distance estimation of a powered system at a location along a route.

In describing particular features of different embodiments of the presently described inventive subject matter, number references will be utilized in relation to the figures accompanying the specification. Similar or identical number references in different figures may be utilized to indicate similar or identical components among different embodiments of the inventive subject matter.

Though example embodiments of the presently described inventive subject matter are described with respect to equipment, example embodiments of the inventive subject matter also are applicable for other uses, such as but not limited to vehicles, such as rail vehicles, other off-highway vehicles (also referred to as OHV, which includes vehicles that are not designed and/or legally permitted for travel on public roadways), marine vessels, automobiles, agricultural vehicles, transport buses, and the like, one or more of which may use at least one engine (e.g., diesel engine), such as an internal combustion engine. Toward this end, when discussing a specified mission, the mission may include a task or requirement to be performed by the equipment. With respect to vehicles, the term "mission" may refer to the movement of the vehicle from a present location to a destination location, or alternatively, to one or more locations between a present location and the destination location. Operating conditions of the equipment may include one or more of speed, load, fueling value, timing, and the like. Furthermore, although diesel powered equipment is disclosed, one or more embodiments disclosed herein also may be utilized with non-diesel powered equipment, such as but not limited to natural gas powered equipment, bio-diesel powered equipment, electric powered equipment, or the like. Furthermore, as disclosed herein, the equipment may include multiple engines, other power sources, and/or additional power sources, such as, but not limited to, battery sources, voltage sources (such as but not limited to capacitors), chemical sources, pressure-based sources (such as but not limited to spring and/or hydraulic expansion), current sources (such as but not limited to inductors), inertial sources (such as but not limited to flywheel devices), gravitational-based power sources, thermal-based power sources, and the like.

In one example involving marine vessels, a plurality of tug boats or vessels (e.g., also referred to as powered units) may be operating together where several or all of the tug boats are moving the same larger marine vessel, the tug boats may be linked in time to accomplish the mission of moving the larger vessel. In another example, a single marine vessel may have a plurality of engines. OHVs may involve a fleet of vehicles that have a common mission to move earth or other materials, from a first location to a different, second location, where each OHV is linked in time to accomplish the mission. In one example involving rail vehicles, a plurality of powered systems (e.g., locomotives or other rail vehicles capable of self-propulsion) may be operating together where all are moving the same larger load and are linked in time to accomplish a mission of moving the larger load. In another example embodiment, a rail vehicle may have more than one powered system.

Figure 2:
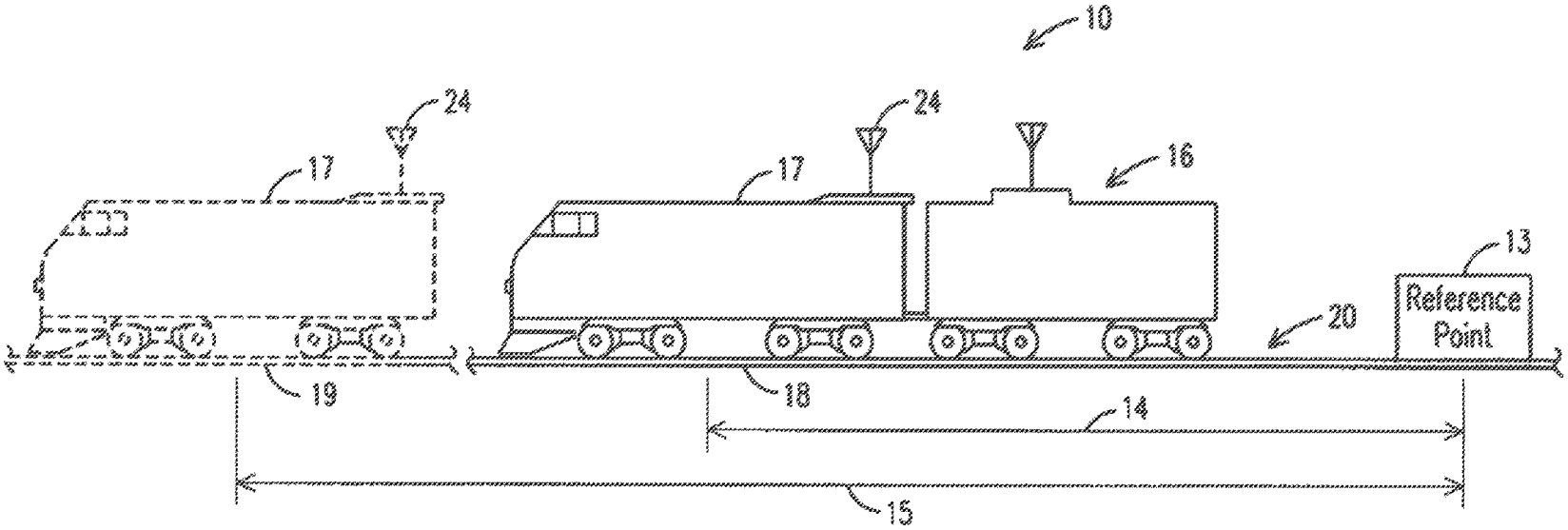
FIG. 2 is a side plan view of one example embodiment of a system for determining a location metric value of a distance estimation of a powered system at a plurality of locations along a route.
Figure 3:
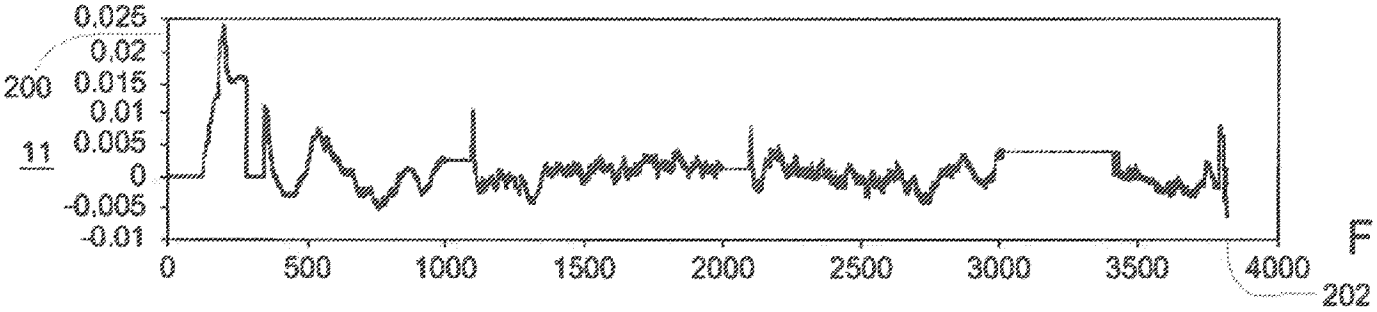
FIG. 3 is a plot of one example embodiment of a first location metric value of a distance estimation of the powered system at a plurality of locations along a route.
Figure 4:
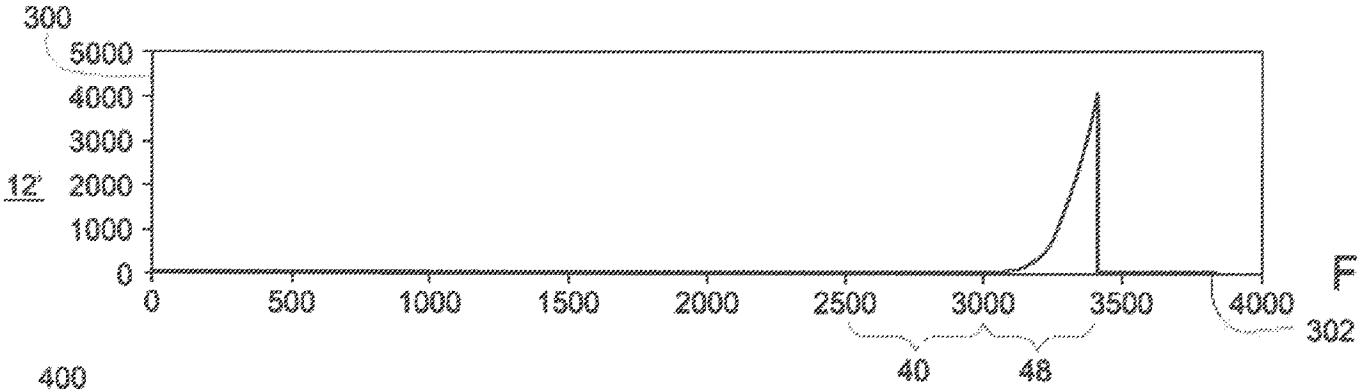
FIG. 4 is a plot of one example embodiment of a second location metric value of a distance estimation of the powered system at a plurality of locations along a route.

FIGS. 1 and 2 illustrate an example embodiment of an evaluation system 10 for determining a location metric value 12 (e.g., as shown in FIGS. 3 and 4) of a distance estimation 14 of equipment system 16, such as a vehicle system having one or more equipment components 17 (e.g., vehicles) at a location 18 along a route 20. The distance estimation 14 is based on a reference point 13 along the route 20, such as a destination location of a trip, a city boundary, a milestone, a wayside device, or any similar reference point. Although the reference point 13 in FIG. 1 is a previous location along the route 20, the reference point 13 may be a future or upcoming location along the route 20, for example. Although the illustrated embodiments of FIGS. 1 through 7 illustrate a system for determining a location metric value of a distance estimation of a vehicle, such as a vehicle system having two or more vehicles mechanically and/or logically coupled with each other for travel, along a route, the embodiments of the inventive subject matter may be employed for other equipment, such as OHVs, marine vehicles, in addition to other applications, for example, which do not travel along a track. One or more embodiments of the presently described inventive subject matter may be employed to determine a location estimation and a respective location metric value of the location estimation for equipment, as the equipment may not follow a prescribed distance along a predetermined route, as with a rail vehicle, for example. The equipment may include a single, moving vehicle, or may include two or more vehicles traveling together in a vehicle system. For example, the two or more vehicles may be mechanically coupled with each other to travel together, or may be separated from each other but communicate with each other to travel together. The term equipment as used herein can include vehicles, vehicle systems, or other types of devices.

The location estimation may be based on (e.g., be a combination of) a speed-based distance estimation and a position-based distance estimation of the equipment at a location from a reference position. The location metric value can represent an accuracy of the location estimation and may be used to determine a quantifiable value of reliability or quality of the location estimation. The location metric value can be representative of differences between estimations of location based on different sources of data. In one embodiment, larger location metric values represent larger differences in the location estimations and, therefore, less reliability in the estimated location of the equipment. Smaller location metric values can represent smaller differences in the location estimations and, therefore, more reliability in the estimated location of the equipment. Alternatively, larger location metric values can represent smaller differences in the location estimations and, therefore, more reliability in the estimated location of the equipment. Smaller location metric values can represent larger differences in the location estimations and, therefore, less reliability in the estimated location of the equipment.

The evaluation system 10 includes a speed sensor 22 positioned on the equipment 17 to measure a speed of the equipment 17 or equipment system 16 at the location 18 along the route 20. The speed sensor 22 may be any type of speed sensors used to measure the speed of moving equipment, such as a wheel speed sensor. The evaluation system 10 further includes a controller 34 coupled to the speed sensor 22. The speed sensor 22 measures one or more characteristics of movement of the equipment 17 (e.g., revolutions per minute of one or more wheels, axles, engines, and the like, velocity of the equipment 17, and the like) and generates speed data representative of the movement of the equipment 17. The speed data may be or include a measurement of the actual speed of the equipment 17 or may include information that is used by the controller 34 to calculate or determine the velocity of the equipment 17. The controller 34 determines a first distance estimation 30 of the equipment from the reference point 13 along the route 20 based on the speed of the equipment or equipment system from the reference point 13 to the location 18 along the route 20. The first distance estimation 30 may be referred to as a speed-based distance estimation. In one embodiment, the controller 34 integrates the speed of the equipment or equipment system over the time period that the equipment or equipment system travels between the reference point 13 and the location 18 to determine the first distance estimation 30. Although the speed sensor 22 illustrated in FIG. 1 is configured to send speed data to the controller 34, and the controller 34 calculates the first distance estimation 30, speed sensors that internally calculate the first distance estimation 30 and transmit the first distance estimation 30 to a second controller, as discussed below. In one embodiment, in addition to the speed data, the speed sensor 22 can output an uncertainty signal 39 to the controller 34, which is subsequently transmitted to a second controller (see below) for determining a third location metric value 12 of the distance estimation 14. The uncertainty signal 39 is indicative of a level of uncertainty in the measured speed of the equipment or equipment system. The level of uncertainty may be a tunable (e.g., adjustable) constant. The uncertainty signal 39 may come directly from the speed sensor 22 to the second controller 28, for example.

The evaluation system 10 further includes a position determination device 24, such as a transceiver or receiver, and associated communication circuitry, for example, to acquire location data representative of a measured position of the equipment or equipment system. In one embodiment, the position determination device 24 is a GPS device configured to communicate with a plurality of off-board data sources 44, 46. The off-board data sources 44, 46 can include, but are not limited to, global positioning satellites, for example. Alternatively, the off-board data sources 44, 46 can be road side transponders that communicate using electromagnetic waves (e.g., radio frequency identification tags), or other sources of location data that are off-board the equipment 16, 17. Although FIG. 1 illustrates a pair of off-board data sources 44, 46, the position determination device 24 may be configured to communicate with more than two off-board data sources, for example. The position determination device 24 may determine the actual position (e.g., location) of the equipment as the location data. Alternatively, the position determination device 24 may generate the location data as being representative of the location data, such as the information received from the off-board data sources 44, 46. For example, the position determination device 24 may receive message signals from the off-board data sources 44, 46 that include positions of the data sources and the times at which the message signals are transmitted from the data sources 44, 46. The position determination device 24 can determine distances from the data sources 44, 46 to the position determination device 24 from this information and determine the position of the equipment 16 and/or 17 based on these distances. The position determination device 24 may then communicate the position of the equipment 16 or equipment system 17 as the location data to the controller 34. Alternatively, the position determination device 24 can communicate the message signals received from the off-board data sources 44, 46 as the location data, the distances from the off-board data sources 44, 46 to the position determination device 24 as the location data, the positions of the off-board data sources 44, 46, and/or the times at which the off-board data sources 44, 46 transmit the message signals as the location data to the controller 34. The controller 34 may then determine the position of the equipment 16 or equipment 17 from the location data.

In another embodiment, the position determination device 24 may receive the speed data from the speed sensor 22 and determine the speed-based distance estimation 30. For example, the position determination device 24 may integrate the speed data over time to determine the distance estimation 30.

The controller 34, speed sensor 22, and position determination device 24 may all be disposed onboard a single component of equipment 17 of an equipment system 16 that includes one or more components of equipment 17. Alternatively, one or more of the controller 34, the speed sensor 22, and/or the position determination device 24 may be located onboard other equipment 17 or a non-powered unit (e.g., a vehicle incapable of self-propulsion but that may otherwise consume electric current to power one or more loads) of the same equipment system 16.

In one embodiment, in contrast with the first distance estimation 30 of the equipment system 16 from the reference point 13 to the location 18 along the route 20, the measured position of the equipment system 16 or equipment 17 may be a raw position of the equipment system 16 or equipment 17 (e.g., a latitude/longitude of the equipment system 16 or equipment 17, for example), and may not correlate or represent a distance of the equipment system 16 or equipment 17 from the reference point 13 along the route 20. Although FIG. 1 illustrates one position determination device 24 (e.g., a single transceiver), more than one position determination device 24 may be provided, such as two or more GPS sensors, wayside equipment, manual input from an operator (upon recognizing a milepost, for example), and any combination thereof. Additionally, although the equipment system 16 illustrated in FIG. 1 includes one equipment unit 17, more than one equipment unit 17 may be included in an equipment system 16, and each equipment 17 or more than equipment 17 may utilize one or more of the above-mentioned position determination device(s) to determine a distance estimation and a quality value of a respective distance estimation to each unit of equipment 17. By utilizing more than one position determination device 24, a more accurate distance estimation and location metric value of the distance estimation may be achieved. For example, if ten position determination devices 24 were utilized and provide distances in the range of 21.3 to 21.4 miles (e.g., 34.3 to 34.4 km), a relatively good location metric value could accompany a distance estimation in that range. If fewer (e.g., two) position determination devices 24 were utilized and provide distances of 25 and 30 miles (e.g., 40 to 48 km), a relatively bad location metric value could accompany a distance estimation based on these distances. In an example embodiment, in determining the distance estimation 14, a second controller (see below) may compute an average, median, standard deviation, or other statistical measure of a plurality of distance estimations 14 provided from a plurality of position determination devices 24. For example, if ten position determination devices 24 provide ten distance estimations with an average of 21.3 miles (e.g., 34.3 km), this average may be used to calculate the location metric value of a distance estimation that is used to control operations of the equipment system 16 and/or to direct the operator to control operations of the equipment system 16. However, the second controller may evaluate the standard deviation of these ten distances, which for example may range between 18 to 27 miles (e.g., 29 and 43 km), and thus, may base the location metric value of the distance estimation on the standard deviation.

The controller 34 is coupled to the position determination device 24. The controller 34 converts the measured position of the equipment system 16 into a second distance 32 of the equipment system 16 along the route 20. The second distance 32 may be referred to as a position-based distance. The controller 34 can determine the second distance 32 based on a memory 36 of the controller 34 that stores the second distance 32 of the equipment system 16 along the route 20. The memory 36 can store a list of the measured positions (e.g., in terms of latitude/longitude) for the entire route 20, and the distance of each measured position from the reference point 13 along the route 20 as the second distance 32. Although the position determination device 24 illustrated in FIG. 1 can transmit a measured position to the controller 34 which is subsequently converted to the second distance 32 from the reference point 13 along the route 20 by the controller 34, the position determination device 24 may perform this conversion and store the second distance 32 in an internal memory similar to the memory 36 of the controller 34. The position determination device 24 can output an uncertainty signal 38 to a second controller (see below) for determining the third location metric value 12 of the distance estimation 14. The uncertainty signal 38 is indicative of a level of uncertainty in the measured position of the equipment system 16, and may be reflective of the number of off-board data sources 44, 46 in sufficient communication with the position determination device 24, for example. The uncertainty signal 38 may represent or be a dilution of precision (DOP) value, which is a unitless value between 1 and 5, where a higher number if indicative of greater uncertainty in the measured position of the equipment system 16. Alternatively, the uncertainty signal 38 may represent a deviation (e.g., a standard deviation, variance measurement, and the like) of several distance estimations 14.

The evaluation system 10 can further include a second controller 28 configured to determine the distance estimation 14 of the equipment system 16 at the location 18 along the route 20 and/or the third location metric value 12 of the distance estimation 14 of the equipment system 16 at the location 18 along the route 20. As illustrated in FIG. 1, the second controller 28 can determine the distance estimation 14 and the third location metric value 12 of the distance estimation 14 based upon several input parameters, such as the first distance 30 of the equipment system 16 along the route 20 that is based on the speed of the equipment system 16, the second distance 32 of the equipment system 16 along the route 20 that is based on the measured position of the equipment system 16, the uncertainty signal 39 provided from the speed sensor 22, and/or the uncertainty signal 38 provided from the position determination device 24. The second controller 28 may base the determination of the distance estimation 14 and the third location metric value 12 based on less than or more than these input parameters. In one example embodiment, the second controller includes or represents a Kalman filter. For example, the second controller may determine the distance estimation 14 and the location metric value 12 using the speed-based distance estimation and the location-based distance estimation as inputs into a Kalman filter.

As further illustrated in the example embodiment of FIG. 1, the second controller 28 includes a memory 42. The memory 42 stores prior distance estimations and respective prior location metric values for previous locations spaced apart from the location 18 along the route 20. As illustrated in the embodiments shown in FIGS. 3 and 4, which represent time plots of the first and third location metric values 11 (FIG. 3), 12 (FIG. 5) of the distance estimation 14 over time (where time is represented by horizontal axes 202 and 402 in FIGS. 3 and 5, respectively), during a first time period 40 (approximately t=2500 to 3000 in FIGS. 3 and 5), the location determining device 24 provides a measured position of the equipment system 16. During this first time period 40, the second controller 28 determines the first and third location metric values 11, 12 of distance estimation 14 based on the first distance 30, the second distance 32, the uncertainty signal 38, and the prior location metric values provided from the second controller memory 42. Although one example embodiment of the inventive subject matter involves the second controller 28 determining the first and third location metric values 11, 12 based on the first distance 30, the second distance 32, the uncertainty signal 38, and the prior location metric values, the second controller 28 may determine the first and third location metric values 11, 12 based on less or more than these values. The third location metric value 12 of the illustrated embodiment of FIG. 5 (as shown alongside a vertical axis 400 which is measured in feet or another unit) is based on the absolute value of the first location metric value 11 of the example embodiment of FIG. 3 (as represented along a vertical axis 200), with the exception of a second time period 48 when the position determination device 24 fails to provide a measured position of the equipment system 16 (described below). As an example, if at a time $t_1$=2600 during the first time period 40, the first distance 30 is 100 feet (e.g., 30.5 meters), the second distance 32 is 95 feet (e.g., 28.9 meters), the uncertainty signal 38 is 4 (e.g., high or significant uncertainty), and a prior location metric value before $t_1$ was 3 feet (e.g., 0.9 meters), the second controller 28 may determine that the third location metric value 12 is 4 feet (e.g., 1.2 meters). Since the uncertainty signal 38 was relatively high, the second controller 28 may increase the third location metric value 12 from a prior value of 3 feet (e.g., 0.9 meters) to the value of 4 feet (e.g., 1.2 meters). Thus, the second controller 28 can continuously or periodically propagate the third location metric value 12 based on the uncertainty signal 38, the first distance 30, the second distance 32, and one or more prior location metric values. Also, the second controller 28 can compute the distance estimation 14 by adding the third location metric value 12 to the second distance 32 (if the second distance 32 is less than the first distance 30), or by subtracting the third location metric value 12 from the second distance 32 (if the second distance 32 is greater than the first distance 30). In this example, the second distance 32 is less than the first distance 30, so the second controller 28 adds the third location metric value 12 to the second distance 32 to arrive at the distance estimation 14 (e.g., 95 feet+4 feet=99 feet). To continue this example, at a second time $t_2$=2800 during the first time period 40, the first distance 30 is 250 feet (e.g., 76.2 meters), the second distance 32 is 240 feet (e.g., 73.2 meters), the uncertainty signal 38 is 2 (e.g., relatively low uncertainty), and the previous third location metric value 12 was 3 feet (0.9 meters), as previously computed. Since the uncertainty signal 38 is relatively low, the second controller 28 can decrease the third location metric value 12 from a prior value of 4 feet (e.g., 1.2 meters), to the value of 3 feet (e.g., 0.9 meters), for example. Additionally, the second controller 28 can compute the distance estimation 15 (FIG. 2) of the equipment system 16 at the later time $t_2$ to be the sum of the second distance 32 and the new third location metric value 12 (e.g., 240 feet+3 feet=243 feet). FIG. 2 illustrates the distance estimations 14, 15 of the equipment system 16 at the respective times $t_1$, $t_2$. The numeric distances are provided as examples, and thus the second controller 28 may determine the same or different values as those above.

The speed sensor 22 can continuously or periodically measure the speed of the equipment 17 and/or continuously or periodically provide the speed data to the controller 34. The second controller 28 also may receive the first distances 30 on a continuous or periodic time interval basis. The position determination device 24 may not continuously or periodically provide measured positions of the equipment system 16, but may instead provide the measured positions at diluted time intervals, such as times that are based on the availability of the message signals from the off-board data sources 44, 46, in addition to other factors, such as in response to manual and/or automatically generated prompts, for example. Thus, the second controller 28 can receive the second distance 32 data from the controller 34 on a diluted time interval basis. Based on the difference in the repeated (e.g., continuous or periodic) and diluted time intervals of the respective first and second distances 30, 32 provided to the second controller 28, the second controller 28 can dynamically determine the third location metric value 12 of the distance estimations on a diluted time interval basis, which effectively acts as a correction to the first distance 30 provided on the continuous or periodic time interval basis.

Figure 5:
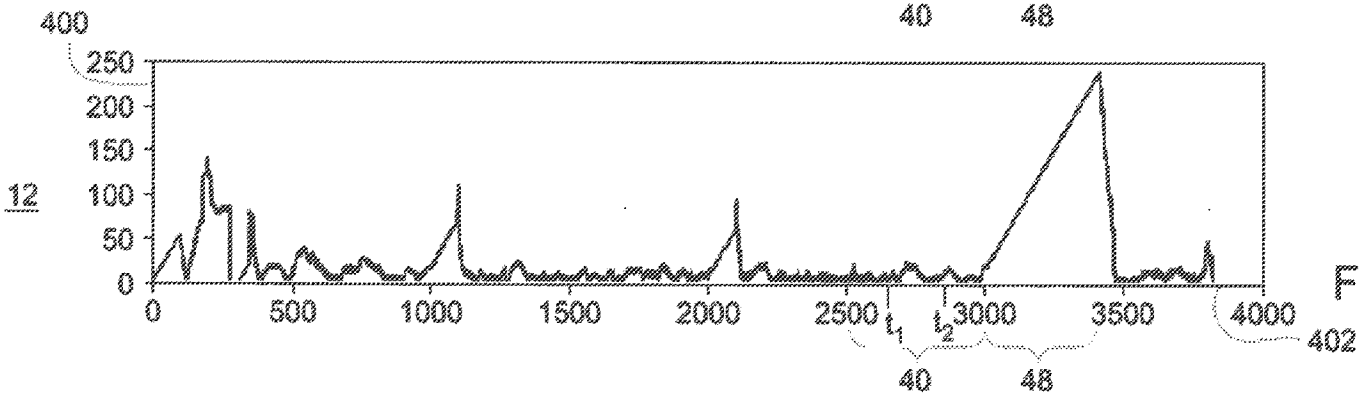
FIG. 5 is a plot of one example embodiment of a third location metric value of a distance estimation of the powered system at a plurality of locations along a route.

As further illustrated in the exemplary embodiment of FIGS. 3 and 5, during a second time period 48 (approximately t=3000-3500), the position determination device 24 ceases to provide the measured position of the equipment 17 or equipment system 16 or position data that can be used to determine the measured position of the equipment 17 or equipment system 16. To determine if the position determination device 24 has ceased to provide a measured position of the equipment 17 or equipment system 16, the controller 34 compares the first distance 30 and the second distance 32 to determine a precision of the second distance 32 relative to the first distance 30. The controller 34 can determine if the precision falls below a threshold level for at least a threshold period of time. If the controller 34 determines that the position determination device 24 has not provided any measured position or position data for at least the threshold period of time, or that the measured position or position data is not adequately precise, the controller 34 may send a modification signal to the second controller 28 to direct the second controller 28 to modify the method used by the second controller 28 to compute the third quality value 12 of the distance estimation 14, as described below. During the second time period 48, the first location metric value 11 in FIG. 3 is essentially flat, as in this particular embodiment, the second controller 28 equates the current location metric value with the prior location metric value. For the third location metric value 12 of the distance estimation 14 in the embodiment of FIG. 5, however, the second controller 28 can determine an increase in the third location metric value 12 based on a location metric value prior to the position determination device 24 having ceased to provide a measured position of the equipment 17 or equipment system 16 and based on a pair of configurable constants K1, K2 (which are based on an uncertainty in the speed of the equipment 17 or equipment system 16) as follows:

$$\text{Location Metric Value Increase } (t) = K2 * \text{Previous Value of Location Metric} * t + K1 * t \quad \text{(Eqn. 1)}$$

Accordingly, during the initial portion of the second time period 48 in FIG. 5, the third location metric value 12 essentially is an increasing line having a slope based on the product of the previous quality value prior to the position determination device 24 having ceased to provide a measured position or position data and a configurable constant K2 that is based on the speed uncertainty 39. During the second time period 48, when the position determination device 24 has resumed communication with the controller 34, the second controller 28 can determine a decrease in the third location metric value 12 based on the previous location metric value prior the position determination device 24 starting to resume communication to provide a measured position of the equipment 17 or equipment system 16 and a skew based on the position uncertainty signal 38, as follows:

$$\text{Location Metric Value Decrease } (t) = \text{Previous Location Metric Value} + \text{skew (based on position uncertainty signal)} \quad \text{(Eqn. 2)}$$

Accordingly, as the value of the position uncertainty signal 38 that is provided from the position determination device 24 decreases, the greater the decrease in the location metric value back down to the range of location metric values prior to the position determination device 24 having ceased to provide the measured position. The third location metric value 12 can increase once the position determination device 24 ceases to provide a measured position since only one distance measurement (e.g., the speed-based distance 30) is being utilized to determine the location of the equipment 17 or equipment system 16, and the distance measurement that is based on the location data provided by the position determination device 24 will not be relied upon significantly until the position uncertainty signal 38 is once again relatively low.

The controller 34 may operate according to a trip plan to autonomously control operations of the equipment 17 or equipment system 16 according to designated operational parameters of a trip plan and/or to direct an operator of the equipment 17 or equipment system 16 to manually control operations of the equipment 17 or equipment system 16 according to the operational parameters of the trip plan. The trip plan may include designated (e.g., predetermined) operational parameters of the equipment 17 or equipment system 16, such as operational settings (e.g., throttle settings, brake settings, speeds, accelerations, braking efforts, and the like). The operational parameters may be expressed as a function of position along the route or distance traveled along the route during the trip. The controller 34 may automatically control the equipment 17 or equipment system 16 according to the trip plan, such as by implementing the designated operational parameters of the equipment 17 or equipment system 16 as the equipment 17 or equipment system 16 reaches a corresponding position or distance traveled in the trip. Alternatively or additionally, the controller 34 may direct an operator of the equipment 17 or equipment system 16 to manually implement the designated operational parameters, such as by displaying or otherwise presenting instructions to the operator on how to control the actual parameters of the equipment 17 or equipment system 16 to match the designated operational parameters of the trip plan when the equipment 17 or equipment system 16 reaches the corresponding location or distance of the trip plan. In one embodiment, the controller 34 determines or obtains initial designated parameters of a trip plan for the equipment 17 or equipment system 16 for each location or several different locations along the route 20 prior to the equipment 17 or equipment system 16 commencing a trip along the route 20 or while the equipment 17 or equipment system 16 is traveling along the route 20. The controller 34 can use the distance estimation 14 and the third location metric value 12 of the distance estimation 14 to control the actual parameters of the equipment 17 or equipment system 16. For example, the controller 34 can manually direct the operator or automatically adjust the actual parameters of the equipment 17 or equipment system 16 to match or approach the designated parameters of the trip plan at one or more upcoming locations 19 (FIG. 2) along the route 20 as the equipment 17 or equipment system 16 travels along the route 20. For example, the controller 34 in the automatic mode may use the distance estimation 14 and the third location metric value 12 at the initial location 18, in a worse case scenario, when determining when to change actual parameters of the equipment or equipment system 16 to the designated parameters planned for the upcoming location 19. For example, if the third location metric value 12 of the distance estimation 14 is 10 feet (e.g., 3.0 meters), then the controller 34 may plan to modify the actual parameters of the equipment 17 or equipment system 16 to match or approach the designated parameters of the trip plan that are associated with the upcoming location 19 in the trip plan to a location that is 10 feet (e.g., 3.0 meters) short of the upcoming location 19. The controller 34 may use the distance estimation 15 of the upcoming location 19 to confirm when the equipment 17 or equipment system 16 actually is at the upcoming location 19 to track the accuracy of the actual parameters of the equipment 17 or equipment system 16 relative to the designated parameters of the trip plan at the upcoming location 19, such as by determining differences between the actual and designated parameters. In one embodiment, if the designated parameter dictates the speed of the equipment or equipment system 16, the distance estimation 14 and the third location metric value 12 of the distance estimation 14 may be utilized to adjust the actual speed of the equipment 17 or equipment system 16 at a distance prior to the upcoming location 19 of the equipment 17 or equipment system 16 (where the third location metric value 12 may be used to determine the distance prior to the upcoming location 19), so that the equipment 17 or equipment system 16 complies with a speed restriction at the upcoming location 19 along the route 20. The controller 34 can be switchable from an automatic mode where parameters of the equipment 17 or equipment system 16 are automatically controlled according to the trip plan to a manual mode, in which the controller 34 directs the operator how to control the parameters of the equipment 17 or equipment system 16 according to the trip plan. The controller 34 can be configured to switch from the automatic mode to the manual mode when the third location metric value 12 is outside a predetermined acceptable range stored in the memory 36 of the controller 34.

Figure 6:
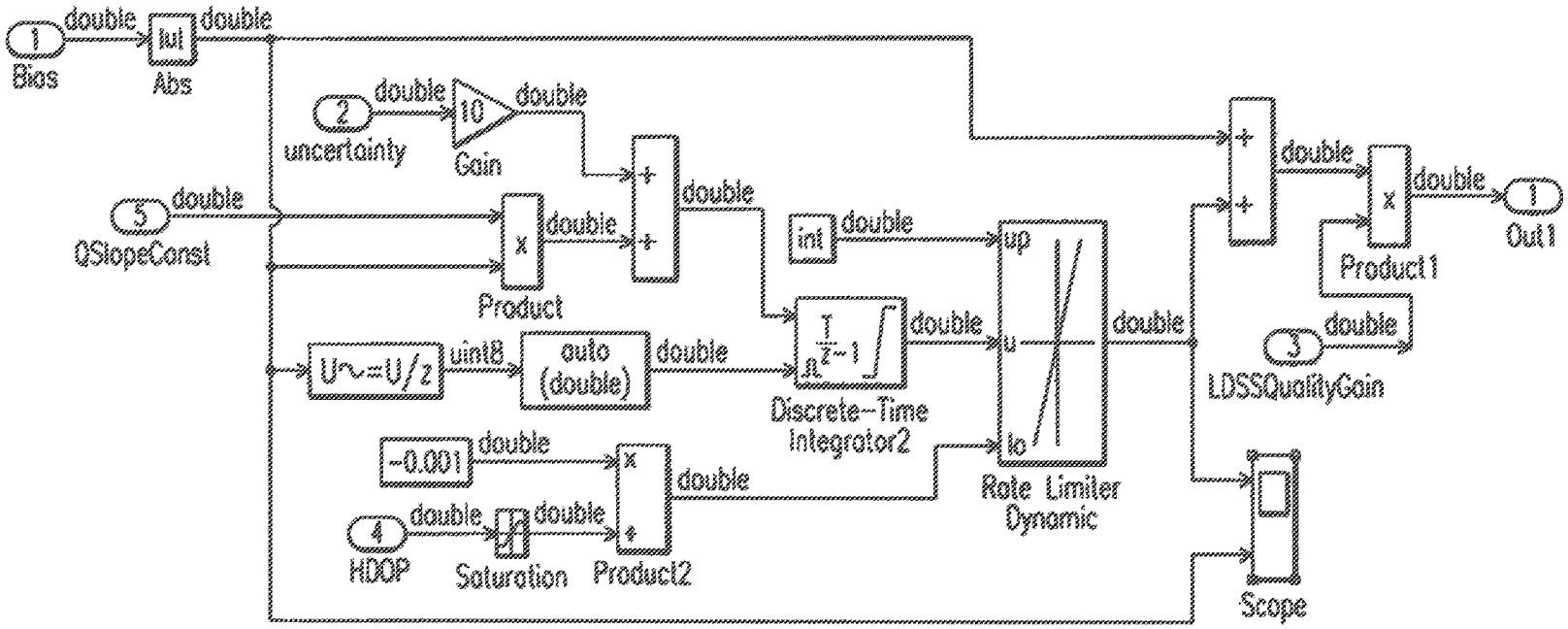
FIG. 6 is a block diagram of one example embodiment of a second controller configured to determine a location metric value of a distance estimation of a powered system at a plurality of locations along a route.

FIG. 6 illustrates an example embodiment of a block diagram of the internal operations of the second controller 28. FIG. 6 is one example of a block diagram arrangement of the second controller 28, and other various block diagram arrangements are possible.

Figure 7:
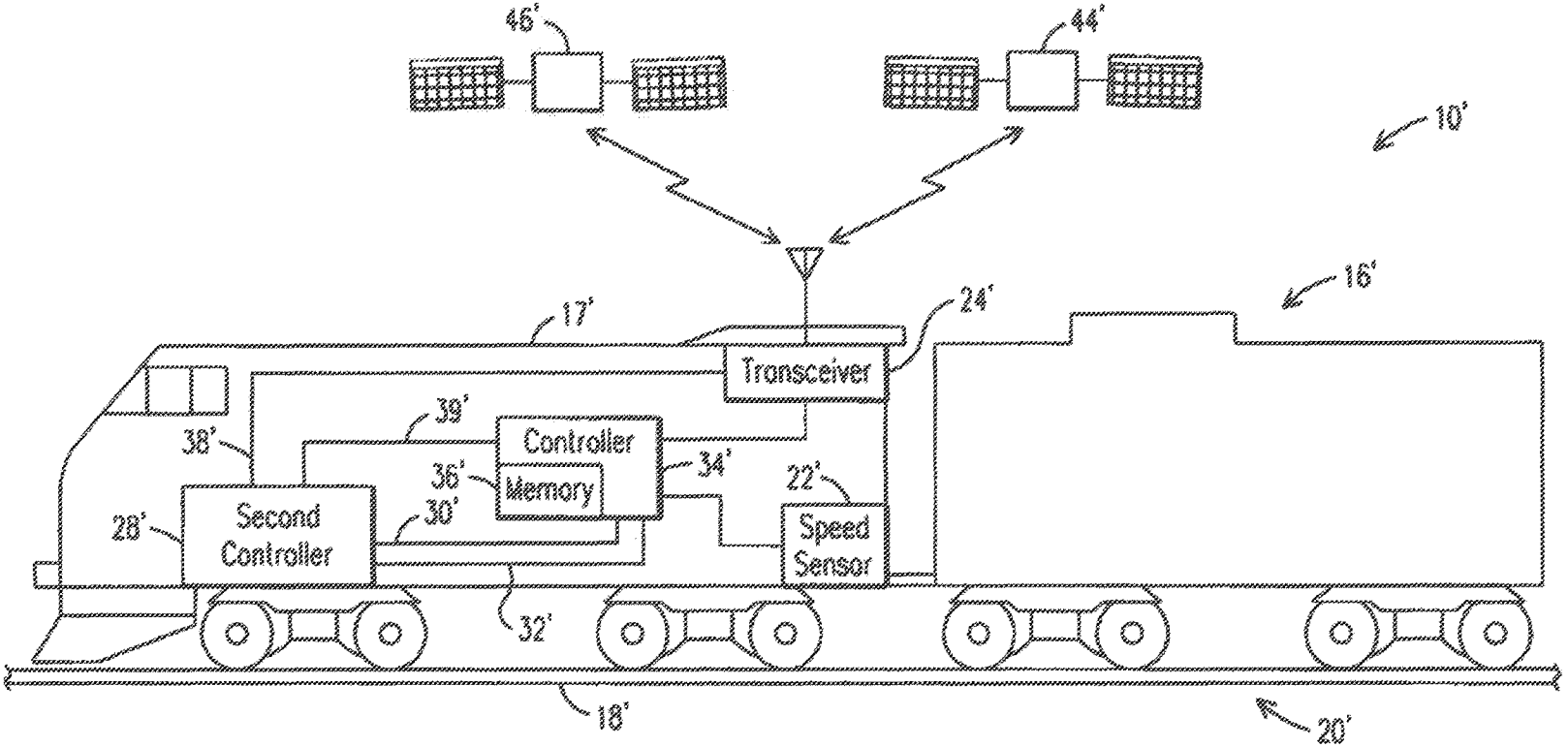
FIG. 7 is a side plan view of one example embodiment of a system for determining a location metric value of a distance estimation of a powered system at a location along a route.

FIG. 7 illustrates an additional embodiment of an evaluation system 10' for determining a second location metric value 12' (FIG. 4) of a distance estimation of an equipment or equipment system 16' at a location 18' along a route 20'. The second location metric value 12' is shown alongside a horizontal axis 302 representative of time and a vertical axis 300 that is representative of the values of the second location metric value 12' in feet. The system 10' includes a speed sensor 22' to determine speed data that is representative of the speed of the equipment or equipment system 16' at the location 18' along the route 20'. The system 10' further includes a position determination device 24' (e.g., transceiver or receiver, and associated communication circuitry) to obtain position data representative of a position of the equipment or equipment system 16'. The system 10' further includes a second controller 28' to determine the second location metric value 12' of the distance estimation during a first time period 40' when the position determination device 24' measures the position of the equipment or equipment system 16'. As illustrated in the plots of FIG. 4 and FIG. 7, the second location metric value 12' is based on the uncertainty signal 38' and an uncertainty signal 39' in the speed of the equipment or equipment system 16'. Although the example embodiment describes that the second location metric value 12' is based on the sum of the uncertainties in the measured position and the speed, the second location metric value 12' may be based on only one of these uncertainties. As shown in the plot of FIG. 4 during the second time period 48, the second location metric value 12' increases to a large number (approx 4000 feet) due at least in part to the second location metric value 12' being based on the sum of the uncertainties in the speed and the measured position. Other versions of the system 10' may be adjusted, however, such that the second location metric value 12' does not increase to such large amounts. The second controller 28' can be configured to determine the distance estimation based upon the first distance 30', the second distance 32', and the second location metric value 12' of the distance estimation.

One or more functions of operating or controlling the equipment 17 or equipment system 16 may change based on the location metric value of the distance estimation, changes in the location metric value, and/or comparisons between the location or distance estimations that are based on different sources of data.

In one example, the equipment or equipment system may be controlled based on which of the location estimations place the equipment or equipment system in a more conservative location. Different areas in which the equipment or equipment system may travel can be governed by different speed limits, can be governed by different limitations on which equipment is allowed to be in the areas, or the like. The areas can be governed by different restrictions in that laws, regulations, or the like, may restrict the speeds, types of equipment, types of cargo, etc., that are allowed in the corresponding areas. If the position-based location estimation and the speed-based location estimation indicate that the equipment or equipment system is in or is approaching different areas that are governed by different limits, then the controller 34 may control the equipment or equipment system, and/or output the location of the equipment or equipment system to an operator, using the location estimation that places the equipment or equipment system in or approaching the area governed by the tighter or more restrictive limits. As one example, different areas may be governed by different speed limits and/or restrictions on the types of equipment or equipment systems that are allowed to travel in the area. If the speed-based location of the equipment or equipment system indicates that the equipment or equipment system is in a first area governed by a slower speed limit and/or that does not allow the equipment or equipment system to be in the first area, but the position-based location of the equipment indicates that the equipment is in a different, second area governed by a faster speed limit and/or that allows the equipment or equipment system, then the controller 34 may control the equipment or equipment system, and/or present the location of the equipment or equipment system, based on the speed-based location estimation.

As described above, the controller 34 may rely on the distance estimation 14 to automatically control operations of the equipment 17 or equipment system 16 according to a trip plan. In one embodiment, the controller 34 may switch from automatic control of the equipment 17 or equipment system 16 to manual control of the equipment 17 or equipment system 16 responsive to the location metric value of the distance estimation falling outside of a designated range. For example, when the location metric value indicates that the distance estimation is less reliable than before or is no longer reliable (e.g., the value exceeds a designated threshold representative of an upper limit on unreliability of a location or distance estimation or the value falls below a designated threshold representative of a lower limit on reliability of the location or distance estimation), then the controller 34 may stop autonomous control of the equipment 17 or equipment system 16 and may switch to a manual control to allow the operator to take over manual control of the equipment 17 or equipment system 16. Alternatively, the controller 34 may not switch from automatically controlling operations of the equipment 17 or equipment system 16 to manual control of the equipment 17 or equipment system 16 if the equipment 17 or equipment system 16 is traveling less than a speed limit. For example, if the speed data from the speed sensor 22 indicates that the equipment 17 or equipment system 16 is traveling slower than a speed limit of the route 20 by at least a designated amount, then the controller 34 may remain in an automatic mode to autonomously control the operations of the equipment 17 or equipment system 16, even if the location metric value of the distance estimation falls outside of the designated range.

In another embodiment, the controller 34 may present (e.g., visually display on an output device, such as a display device in the equipment 17) a rolling map to an operator of the equipment 17 or equipment system 16. The rolling map may represent where the equipment 17 or equipment system 16 is located that changes as the equipment 17 or equipment system 16 moves. The portion of the map that is currently displayed to the operator may be based on the distance estimation 14. Responsive to the location metric value indicating that the distance estimation 14 is less reliable than before or is no longer reliable, the controller 34 may stop presenting the rolling map to the operator. Optionally, if the position-based location or distance estimation and the speed-based location or distance estimation represent different locations or distances of the equipment or equipment system, then the controller 34 may present the rolling map or the location of the equipment or equipment system on the map in the more conservative of the different location or distance estimations. For example, different areas of the map may be associated with different speed limits. If the position-based location of the equipment indicates that the equipment is in a first area governed by a faster speed limit but the speed-based location of the equipment indicates that the equipment is in a different, second area governed by a slower speed limit, then the controller 34 may present the portion of rolling map and/or the location of the equipment on the map based on the location estimation that is within the area governed by the slower speed limit (e.g., the speed-based location).

Figure 8:
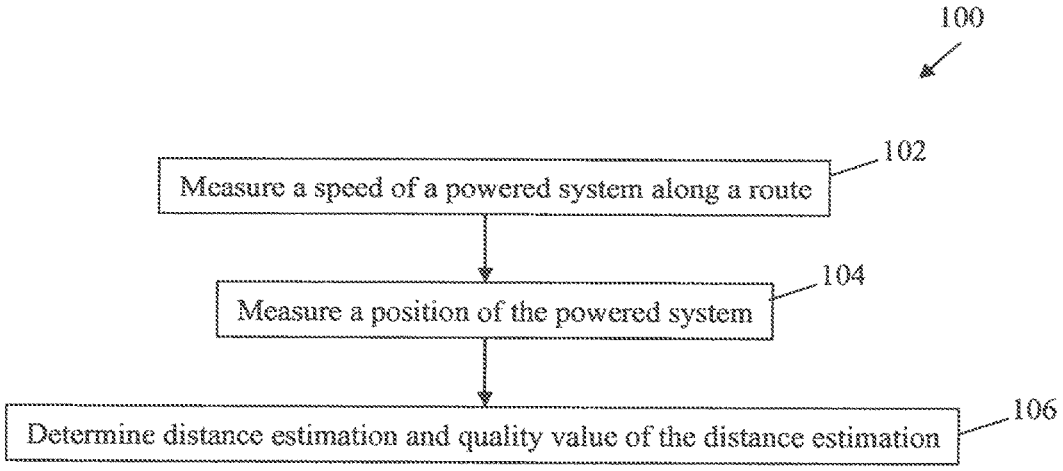
FIG. 8 is a flow chart illustrating one example embodiment of a method for determining a location metric value of a distance estimation of a powered system at a location along a route.

FIG. 8 illustrates a flow chart of an exemplary embodiment of a method 100 for determining a location metric value 12 of a distance estimation 14 of equipment 17 or an equipment system 16 at a location 18 along a route 20. At 102, a speed of the equipment 17 or equipment system 16 is measured at the location 18 along the route 20. At 104, a position of the equipment 17 or equipment system is measured. At 106, the distance estimation 14 of the equipment 17 or equipment system 16 along the route 20 and the location metric value 12 of the distance estimation 14 are determined. The distance estimation 14 and/or the location metric value 12 may be based on a first distance 30 of the equipment 17 or equipment system 16 along the route 20 (which can be based on the speed of the equipment 17 or equipment system 16) and on a second distance 32 of the equipment 17 or equipment system 16 along the route 20 (which can be based on the measured position of the equipment 17 or equipment system 16).

In another embodiment, a method (e.g., for determining a location metric value of a distance estimation of equipment) includes determining a location of equipment based on plural determined positions of the equipment. The determined positions include a position-based location that is based on location data output by a position determination device and a speed-based position based on speed data output by a speed sensor.

In one aspect, the equipment includes a moving vehicle.

In one aspect, the method also includes determining a location metric value of the location of the equipment. The location metric value can be representative of a difference between the position-based location and the speed-based position of the equipment.

In one aspect, the method also can include generating a warning signal responsive to the location metric value exceeding a designated threshold.

In one aspect, the location metric value can represent one or more of a quality metric or a reliability metric of the location of the equipment.

In one aspect, the location of the equipment can be based on one or more of an average or a median of the determined positions.

In one aspect, responsive to the determined positions of the equipment indicating the location of the equipment being in two or more different areas governed by different limits, the method includes one or more of controlling the equipment based on the determined position that indicates the location of the equipment being in a first area of the different areas that is governed by a more restrictive limit than one or more other areas of the different areas, and/or outputting the location of the equipment based on the determined position that indicates the location of the equipment being in the first area of the different areas that is governed by the more restrictive limit than the one or more other areas of the different areas.

In one aspect, the different limits of the different areas restrict one or more of different speed limits, different types of the equipment permitted to be in the different areas, or different types of cargo permitted to be in the different areas.

In one aspect, the method also can include one or more of autonomously controlling and/or directing manual control of operations of the equipment during a trip along a route according to a trip plan. The trip plan can designate operational parameters of the equipment as a function of distance along the route. The autonomously controlling and/or directing manual control of the operations of the equipment can include determining which of the operational parameters designated by the trip plan to use to control the equipment based on the location of the equipment that is determined.

In another embodiment, a system (e.g., a control system) includes at least one controller configured to determine a location of equipment based on plural determined positions of the equipment. The determined positions can include a position-based location that is based on location data and a speed-based position based on speed data. The at least one controller can include a single controller that performs the operations described herein, or multiple controllers that each perform the operations, and/or multiple controllers that each perform different operations and/or different parts of the operations.

In one aspect, the system can include a speed sensor configured to output the speed data representative of a measured speed of the equipment.

In one aspect, the system can include a position determination device configured to output the location data representative of a measured position of the equipment.

In one aspect, the equipment can include a moving vehicle, or a vehicle that is configured to move.

In one aspect, the at least one controller also can be configured to determine a location metric value of the location of the equipment, where the location metric value is representative of a difference between the positioned-based location and the speed-based position of the equipment.

In one aspect, the at least one controller also is configured to generate a warning signal responsive to the location metric value exceeding a designated threshold.

In one aspect, the location metric value can represent one or more of a quality metric and/or a reliability metric of the location of the equipment. For example, the location metric value can be indicative or representative of how accurate that a determined location of the equipment is.

In one aspect, the at least one controller can be configured to determine the location of the equipment based on one or more of an average or a median of the determined positions.

In one aspect, responsive to the determined positions of the equipment indicating the location of the equipment being in two or more different areas governed by different limits, the at least one controller can be configured to one or more of control the equipment based on the determined position that indicates the location of the equipment being in a first area of the different areas that is governed by a more restrictive limit than one or more other areas of the different areas, and/or output the location of the equipment based on the determined position that indicates the location of the equipment being in the first area of the different areas that is governed by the more restrictive limit than the one or more other areas of the different areas.

In one aspect, the different limits of the different areas can restrict one or more of different speed limits, different types of the equipment permitted to be in the different areas, and/or different types of cargo permitted to be in the different areas.

In one aspect, the at least one controller also can be configured to one or more of autonomously control and/or direct manual control of operations of the equipment during a trip along a route according to a trip plan. The trip plan can designate operational parameters of the equipment as a function of distance along the route. The at least one controller can be configured to determine which of the operational parameters designated by the trip plan to use to control the equipment based on the location of the equipment that is determined.

This written description uses examples to disclose embodiments of the inventive subject matter and to enable a person of ordinary skill in the art to make and use the embodiments of the inventive subject matter. The patentable scope of the embodiments of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

a controller configured to determine a location of equipment based on a location data output by a position determination device and a location of the equipment based on speed data output by a speed sensor, the controller also configured to determine when the location of the equipment based on the location data indicates that the equipment is in a first area associated with a first limit on operation of the equipment but the location of the equipment based on the speed data indicates that the equipment is in a different, second area associated with a second limit on the operation of the equipment, wherein the controller is configured to one or more of automatically control or direct manual control of the equipment according to a more restrictive limit of the first limit and the second limit responsive to the location based on the location data and the location based on the speed data being different locations.

2. The system of claim 1, wherein the first and second limits restrict which types of equipment are allowed in the different areas.

3. The system of claim 1, wherein the equipment includes a moving vehicle.

4. The system of claim 1, wherein the controller is further configured to determine a location metric value of the equipment, the location metric value representative of a difference between the location of the equipment based on the location data and the location of the equipment based on the speed data.

5. The system of claim 4, wherein the controller is further configured to generate a warning signal responsive to the location metric value exceeding a designated threshold.

6. The system of claim 1, wherein the first and second limits restrict different speed limits of the first and second areas.

7. The system of claim 1, wherein the first and second limits restrict different types of cargo permitted to be in the first and second areas.

8. The system of claim 1, wherein the controller is further configured to one or more of autonomously control or direct manual control of operations of the equipment during a trip along a route according to a trip plan, the trip plan designating operational parameters of the equipment as a function of distance along the route.

9. The system of claim 8, wherein the controller also is configured to determine which of the operational parameters designated by the trip plan to use to control the equipment based on the more restrictive limit of the first limit and the second limit.

10. A system comprising:

a position determination device associated with equipment and configured to output location data;

a speed sensor associated with the equipment and configured to output speed data; and a controller operably coupled to the position determination device and the speed sensor and configured to determine a location of the equipment based on the location data output by the position determination device and a location of the equipment based on the speed data output by the speed sensor, the controller also configured to determine when the location of the equipment based on the location data indicates that the equipment is in a first area associated with a first limit on operation of the equipment but the location of the equipment based on the speed data indicates that the equipment is in a different, second area associated with a second limit on the operation of the equipment, wherein the controller is configured to one or more of automatically control or direct manual control of the equipment according to a more restrictive limit of the first limit and the second limit responsive to the location based on the location data and the location based on the speed data being different locations.

11. The system of claim 10, wherein the first and second limits restrict which types of equipment are allowed in the first and second areas.

12. The system of claim 10, wherein the equipment includes a moving vehicle.

13. The system of claim 10, wherein the controller is further configured to determine a location metric value of the equipment, the location metric value representative of a difference between the location of the equipment based on the location data and the location of the equipment based on the speed data.

14. The system of claim 13, wherein the controller is further configured to generate a warning signal responsive to the location metric value exceeding a designated threshold.

15. The system of claim 10, wherein the first and second limits restrict different speed limits of the first and second areas.

16. The system of claim 10, wherein the first and second limits restrict different types of cargo permitted to be in the first and second areas.

17. The system of claim 10, wherein the controller is further configured to one or more of autonomously control or direct manual control of operations of the equipment during a trip along a route according to a trip plan, the trip plan designating operational parameters of the equipment as a function of distance along the route.

18. The system of claim 17, wherein the controller also is configured to determine which of the operational parameters designated by the trip plan to use to control the equipment based on the more restrictive limit of the first limit and the second limit.

19. A system comprising:

a position determination device onboard a vehicle;

a speed sensor onboard the vehicle; and a controller onboard the vehicle and configured to determine a location of the vehicle based on a location data output by the position determination device and a location of the vehicle based on speed data output by the speed sensor, the controller also configured to determine when the location of the vehicle based on the location data indicates that the vehicle is in a first area associated with a first limit on operation of the vehicle but the location of the vehicle based on the speed data indicates that the vehicle is in a different, second area associated with a second limit on the operation of the vehicle, wherein the controller is configured to one or more of automatically control or direct manual control of the vehicle according to a more restrictive limit of the first limit and the second limit responsive to the location based on the location data and the location based on the speed data being different locations.

20. The system of claim 19, wherein the vehicle is a rail vehicle.

* * * * *